US005733470A

United States Patent [19]

Roth et al.

[11] Patent Number: 5,733,470

[45] Date of Patent: Mar. 31, 1998

[54] MOLD FOR CASTING GROUND COVERING

[75] Inventors: Dieter Roth, Van Nuys; Mark Silka, Encino, both of Calif.

[73] Assignee: Siroflex of America, Inc., Van Nuys, Calif.

[21] Appl. No.: 435,384

[22] Filed: May 5, 1995

Related U.S. Application Data

[63] Continuation-in-part of Ser. No. 126,184, Sep. 24, 1993, abandoned.

[51] Int. Cl.[6] ..... E01C 07/00

[52] U.S. Cl. ..... 249/2; 249/129; 249/189; 249/205; 264/33; 264/250; 404/89; 404/93; 425/458

[58] Field of Search ..... 425/87, 458; 249/2–4, 249/6, 131, 129, 188–189, 132; 404/41, 42, 89, 93; 264/33, 250

[56] References Cited

U.S. PATENT DOCUMENTS 4,627,764 12/1986 Scheiwiller .
5,487,526 1/1996 Hupp ..... 425/458

OTHER PUBLICATIONS

Fitzgerrell, Scott, Basic Masonry Illustrated, Lane Publshing Co., Menlo Park, CA, pp. 76–77. 1981.
DeCristoforo, R. J., Handy Man's Concrete and Masonry Handbook, Arco Publishing Co., Inc., NY, P. 70. 1960.

*Primary Examiner*—Jay H. Woo
*Assistant Examiner*—Joseph Leyson
*Attorney, Agent, or Firm*—Beirne, Maynard & Parsons L.L.P.

[57] ABSTRACT

A mold for casting ground covering, such as a plurality of stepping stones, has a generally polygon concrete molding frame having top and bottom surfaces in parallel planes and divided into openings. The frame is generally square and may include nesting polygonal configurations. Each wall has a plan shape of contiguous line segments connected at obtuse angles. A first diagonal wall extends approximately from the first corner to the third corner, and a second diagonal wall extends approximately from the second corner to the fourth corner. The first perimeter wall is geometrically congruent with the third perimeter wall and the second perimeter wall is geometrically congruent with the fourth perimeter wall. The diagonal walls are geometrically congruent with the second and fourth perimeter walls.

18 Claims, 8 Drawing Sheets

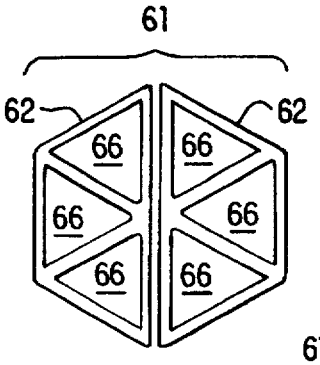
FIG. 29
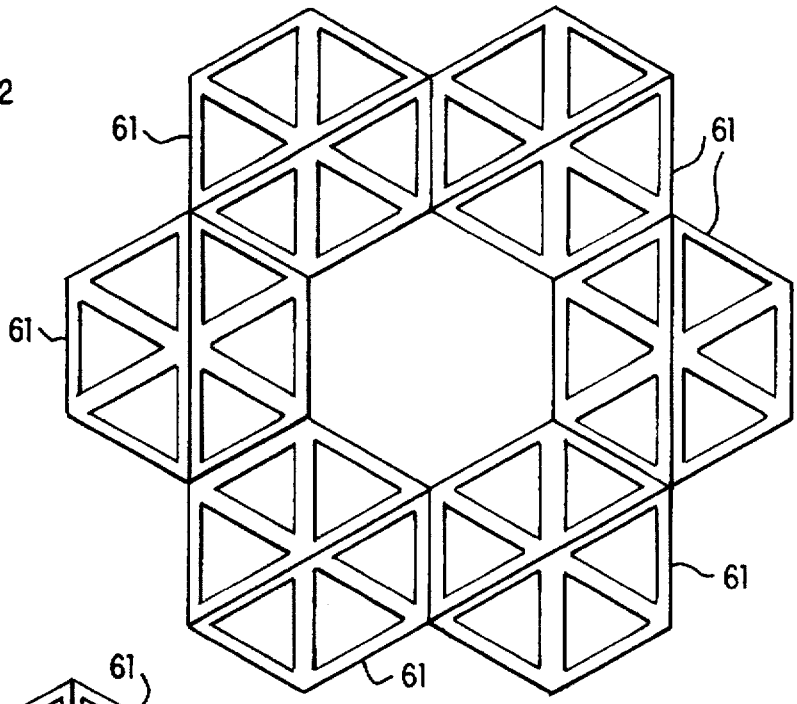
FIG. 32
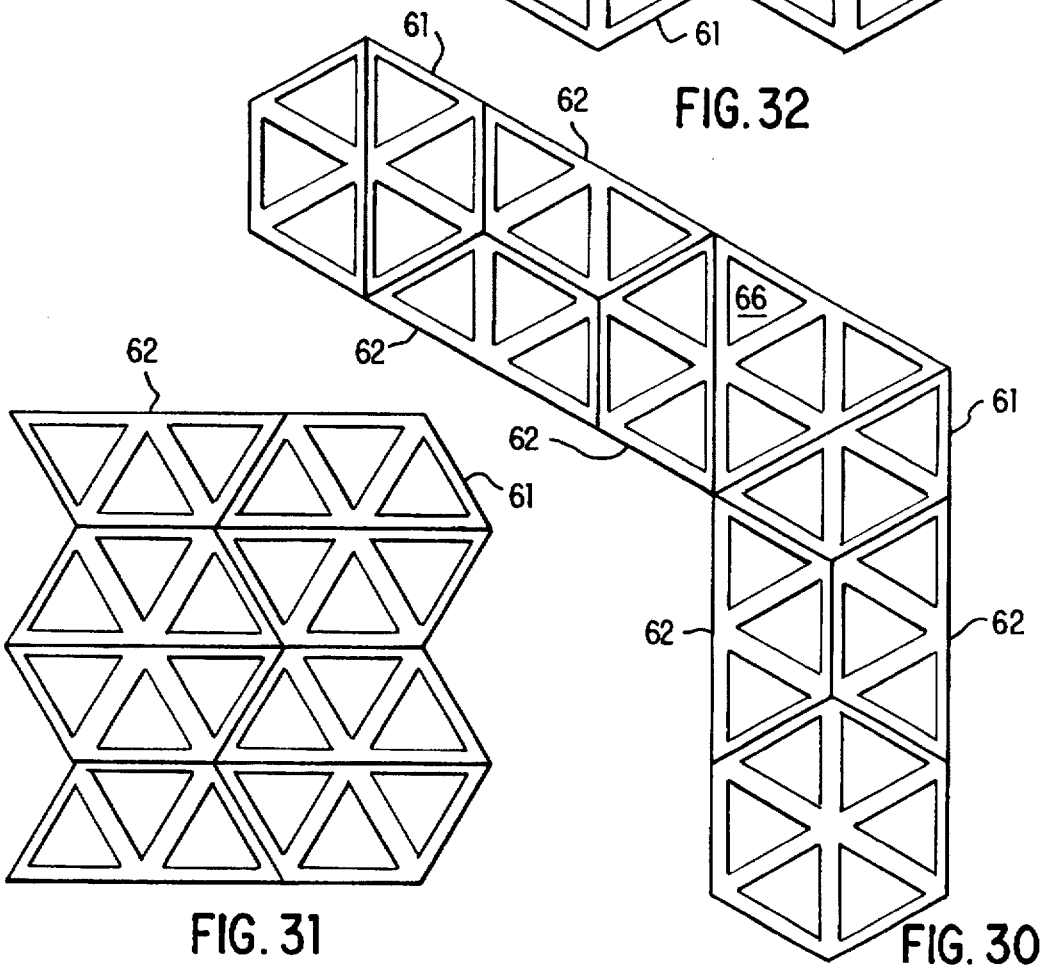
FIG. 30
FIG. 31

MOLD FOR CASTING GROUND COVERING

CROSS REFERENCE TO RELATED APPLICATION

This application is a continuation-in-part application of application Ser. No. 08/126,184, filed Sep. 24, 1993, entitled "Mold for Stepping Stones, now abandoned."

BACKGROUND OF THE INVENTION

1. Field of the Invention

This invention applies to the field of ground covering, such as molds, for casting ground-covering, such as stones, from cement, or similar material, and the ground-covering stepping stones produce by casting such materials in generally planar shaped molding cavities.

2. Description of the Prior Art

There are two principal commercial applications for such molds: The first is the use of the molds by do-it-yourself craftsmen for home improvements. The second is in commercial manufacturing, wherein such molds am employed to manufacture decorative stepping stones for sale to others. The molds and products therefrom disclosed are appropriate for both applications.

There have been a number of prior art molds patented or otherwise known and/or manufactured as decorative patterns. However, these prior art molds and patterns have limited flexibility in use, being capable of producing only rectilinear patterns. Thus, they are incapable of producing oblique, curved or circular patterns.

Of course, most of the actual decorative patterns in use every old, some dating back centuries to the practice of fitting ships ballast stones into reputed decorative patterns to make cobblestone streets at loading ports. Other typical prior art patterns are ancient and traditional Japanese designs, such as that based or evolved therefrom and marketed under the pattern name "Royal Rock," by Color Tile, Inc., having stores throughout the United States.

One prior art mold and ground covering is taught in U.S. Pat. No. 4,354,773 (Noak) for a ground-coveting element.

Additional prior art is shown in U.S. Pat. No. 4,773,790 (Hagenaugh) also for a ground covering element.

A prior art mold pattern is shown in U.S. Design Patent No. D-432,528 (Hupp). This pattern has been marketed under the phrase "Walkmaker", remarkably similar to the above-referenced "Royal Rock" Japanese design.

All of the above prior art devices represent generally rectangular patterns having "zig-zag" sides comprising projections and recesses of approximately equal obtuse angles included between approximately equal line segment lengths.

All of these prior art devices lack the capability to create the variety of straight walks, curves and circular patterns desired by both home-owners and commercial manufacturers. None of the foregoing molds have the capability of selectively casting concrete simulated ground-coveting patterns less than the full pattern enclosed by the perimeter of the molds, and hence, they are limited to rectilinear patterns.

Another prior art mold pattern is shown in the advertisement for the mold, ROCK'N'MOLD®, manufactured by the assignee of the present invention. This product has the capability of being partially filled to produce separate simulated stones in triangular partial patterns within the overall mold to produce various ground-covering configurations. However, this product does not have the capability to monolithically cast adjacent stones.

The ROCK'N'MOLD® II or New ROCK'N'MOLD® is a generally hexagonal mold manufactured and recently marketed by the assignee of the present invention. This product has the capability of casting an overall monolithic pattern of stones filling the entire mold, but lacks the ability of the assignee's previously-marketed ROCK'N'MOLD® to produce simulated stones in partial patterns.

Prior art devices which cast a number of small separate stones have safety problems, as small stones are prone to being moved or tipped in use. Also, small stones require the site to be prepared very flat and well compacted, in order to stay in place in a common plane in use. The average consumer normally does not have the tools and equipment to accomplish such site preparation, nor the case and patience obviously required.

It is a purpose of the present invention to overcome the limitations of all the prior art devices by producing a more versatile mold and ground-covering stone pattern, in which selected portions of the mold may be filled to produce various ground-covering configurations, and also in which those selected portions can produce patterns of monolithically-cast stones.

It is a purpose of the present invention to provide a casting mold that can produce repeated patterns in the form of linear and rectilinear transverse areas, as well as oblique, arcuate and even circular shapes in a single, inexpensive mold.

It is another purpose of the present invention to employ a mold into which separate, nesting, groups of interconnected stones cast and divided by partial dividers, with actual dividers separating the groups of interconnected stones in a nesting relationship.

It is another purpose of the present invention to provide a mold for casting concrete ground-covering elements by which the user can manufacture straight walk-ways, large areas such as patios, oblique patterns, curved walk-ways and even circular patterns, by filling selected portions of the mold.

It is yet another purpose of the present invention to provide a mold for casting safer concrete ground-covering elements in which small stones may be cast, but which are interconnected monolithically with adjacent stones to preclude moving or tipping in use, and to minimize site preparation.

A feature of the present invention is the ability to use any partial dividing wall to produce either an isolated edge for any stones or to produce the monolithic connection between two adjacent stones.

In addition to a square perimeter, other preferred embodiments include additional nesting polygonal, or generally polygonal, configurations including rectangles, triangles, trapezoids and hexagons.

SUMMARY OF THE INVENTION

The foregoing purposes are achieved by the present invention in which a mold for casting a plurality of ground-covering stones comprises a generally square concrete molding frame having top and bottom surfaces in a parallel plane. The frame has first and second corners connected by a first perimeter wall, second and third corners connected by a second perimeter wall, third and fourth corners connected by a third perimeter wall and fourth and first corners connected by a fourth perimeter wall. Each wall has a plan shape of contiguous straight-line segments connected at obtuse angles.

A first diagonal wall extends approximately from the first corner to the third corner, dividing the square frame into two generally triangular portions. A second diagonal wall extends approximately from the second corner to the fourth corner, dividing the square frame into two alternative triangular portions. The first perimeter wall is geometrically congruent with the third perimeter wall and the second perimeter wall is geometrically congruent with the fourth perimeter wall. The diagonal walls are geometrically congruent with the second and fourth perimeter walls.

Individual ground-covering stepping stone patterns are produced by dividing walls extending from the top planar surface of the frame to a plane intermediate of the bottom planar surface, whereby the individual stone patterns are monolithic in the generally triangular portions. In use, the generally square perimeters of repetitive castings nest to form linear, transverse or rectilinear patterns; and the triangular portions mutually nest or nest with sides of the square perimeters to form arcuate or circular repetitively cast patterns.

BRIEF DESCRIPTION OF THE DRAWINGS

FIG. 29 shows how trapezoidal portions of a mold may be filled to produce a hexagonal pattern;

FIG. 30 shows how a plurality of trapezoidal and hexagonal castings of the mold of FIG. 29 may be filled to produce a linear area ground-covering configuration having oblique-direction capability;

FIG. 31 shows how a plurality of castings of the mold of FIG. 29 may be filled to produce a rectilinear ground-coveting configuration; and FIG. 32 shows how a plurality of castings of the mold of FIG. 29 may be filled to produce a circular walk configurations.

DESCRIPTION OF THE PREFERRED EMBODIMENTS

Figure 2:
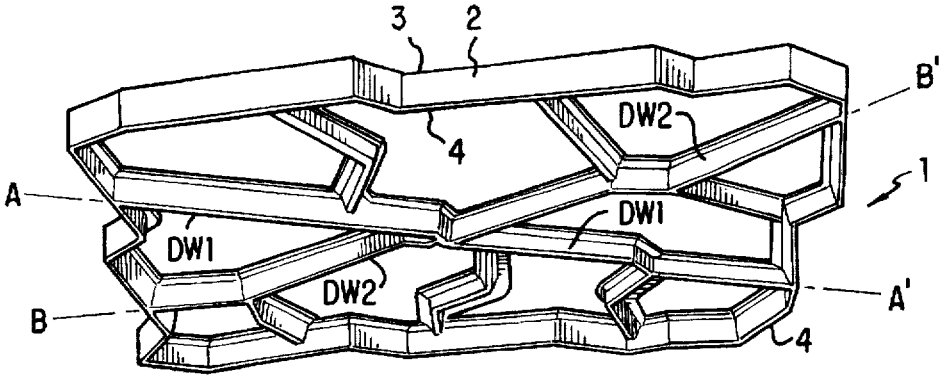
FIG. 2 is a bottom-side perspective view of the mold of FIG. 1.
Figure 1:
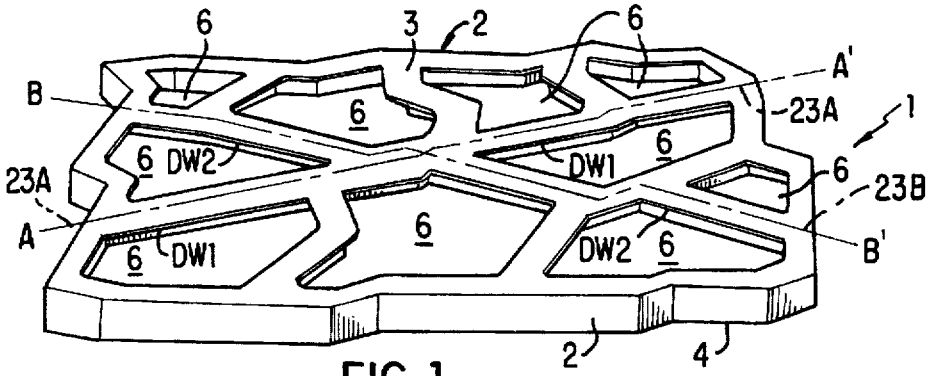
FIG. 1 is a top-side perspective view of a first preferred embodiment of a mold according to the present Invention.

In FIG. 1, a top perspective view, and in FIG. 2, a bottom perspective view, a mold 1 for casting stepping stones according to a preferred embodiment of the invention is shown having a generally square perimeter wall 2 having a planar top surface 3, and a spaced parallel planar bottom surface 4. A first diagonal wall DW1 along centerline 23A extends from A to A'; and a second diagonal wall DW2 along centerline 23B extends from B to B' intersect perimeter wall 2 proximate the corners of the perimeter, separating the square into triangular areas. A plurality of partial dividing walls 5 intersect diagonal walls and perimeter walls to divide the triangular area into irregular shapes 6 simulating stone patterns.

Figure 3:
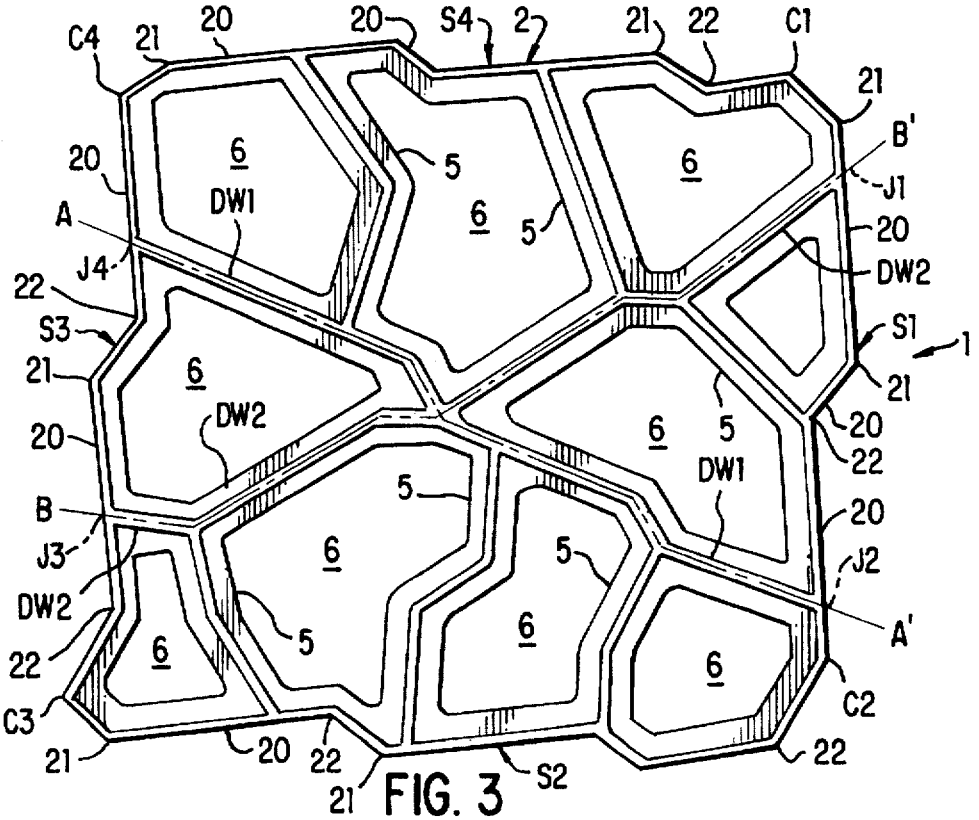
FIG. 3 is a bottom plan view of the mold of FIG. 1.
Figure 4:
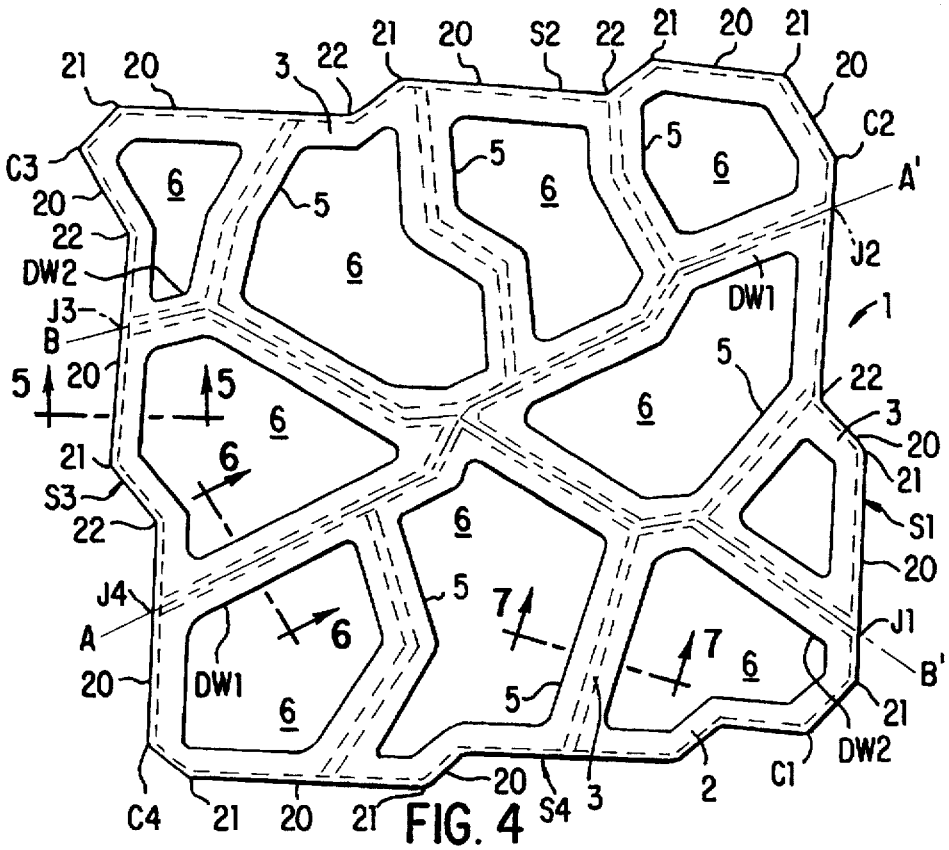
FIG. 4 is a top plan view of the mold of FIG. 1.

In FIG. 3, a bottom plan view of the mold 1 of FIG. 1, and in FIG. 4, a top plan view of the mold of FIG. 1, the invention is shown having a generally square perimeter 2 having a first corner C1 and second corner C2 connected by a first perimeter wall side S 1, second corner C2 and third corner C3 connected by a second perimeter wall side S2, third corner C3 and fourth corner C4 connected by a third perimeter wall side S2 and fourth corner C4 and first corner C1 connected by a fourth perimeter wall side S4, each said perimeter wall having a plan shape comprising a series of contiguous, generally-straight line segments 20 of successive unequal lengths, connected at obtuse angles forming alternating projections 21 and recesses 22.

A first diagonal separating wall DW1 extends along line A–A' from perimeter wall junction J4 proximate fourth corner C4, to perimeter wall junction J2 proximate second corner C2 and comprising a common wall separating the generally square perimeter into a first generally triangular portion J4-C1-J2 and a second generally triangular portion J2-C3-J4.

A second diagonal separating wall DW2 extends along line B-B' from perimeter wall junction J3 proximate the third corner C3, to perimeter wall junction J1 proximate the first corner C1 and comprising a common wall separating the generally square perimeter into a third generally triangular portion J3-C4-J1 and a fourth generally triangular portion J1-C2-J3. First perimeter wall side S1 is geometrically complementary to the third perimeter wall side S3, and the second perimeter wall side S2 is geometrically complementary to fourth perimeter wall side S4.

First diagonal wall DW1 is geometrically complementary to second perimeter wall side S2 and fourth perimeter wall side S4.

Figure 5:
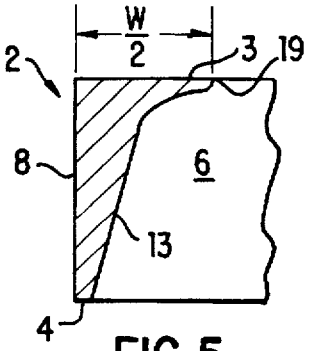
FIG. 5 is an enlarged cross-sectional view of a perimeter side wall of the mold of FIG. 1, taken along section line 5—5.

In FIG. 5, a cross-section of a portion of the perimeter wall 2 of FIG. 4 is shown taken along section line 5—5, in which perimeter wall 2 is in the general configuration of an inverted "L" having a vertical exterior portion 8 extending between the plane of top surface 3 and the plane of bottom surface 4. The angular interior surface 13 of perimeter wall 2 causes perimeter wall 2 to have the cross-sectional shape of an asymmetric "V" in which the top of each side of the V has a radius tapering to an edge 19.

Figure 5A:
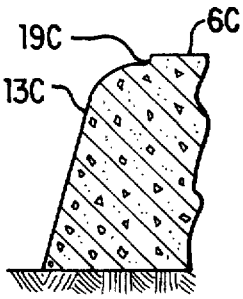
FIG. 5A is a full-size cross-sectional view of the perimeter of a ground-covering element as molded by the portion of the mold of FIG. 5.

In FIG. 5A, the molded side wall of the casting of simulated stone pattern element 6 by perimeter wall 2 is shown as 6C (element 6 casting), having an angular cast surface 13C replicating wall 13 and a radius tapering to edge 19C in top surface 3.

Figure 6:
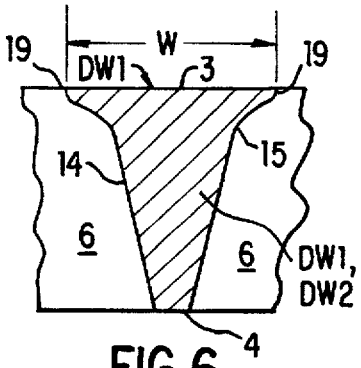
FIG. 6 is an full-size cross-sectional view of a diagonal wall of the mold of FIG. 1, taken along section line 6—6.

In FIG. 6 a cross-section of a portion of a diagonal wall DW1 or DW2 of FIG. 4 is shown taken along section line 6—6, in which diagonal wall DW1 or DW2 has a cross-sectional shape of a "T" having a v-shaped angular vertical surfaces 14 and 15 extending from plane of bottom surface 4 and curving out to opposed top surface edges 19 at top surface 3.

Figure 6A:
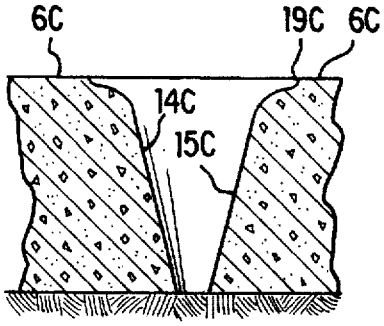
FIG. 6A is a cross-sectional view of a diagonal portion of a section of a ground-covering element molded by the portion of the mold of FIG. 6.

In FIG. 6A, the cast angular walls 14C and 15C are shown as simulated stone pattern cements 6C cast by replicating the surfaces of walls 14 and 15 of the typical diagonal wall of FIG. 6, the cast walls 14C and 15C curving outwards and terminating at cast ledges 19C.

Figure 7:
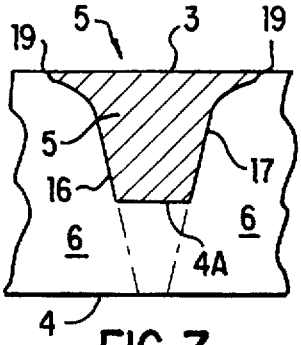
FIG. 7 is an approximately full-size cross-sectional view of a partial dividing wall of the mold of FIG. 1, taken along section line 7—7.

In FIG. 7, a cross-section of a portion of a partial dividing wall 5 of FIG. 4 is shown taken along section line 7—7, in which partial dividing wall 5 has a cross-sectional shape of a "T" having a v-shaped angular vertical surfaces 16 and 17 extending from a truncated intermediate-plane bottom surface 4*a*, curving out to opposed top surface edges 19 at planar top surface 3.

Figure 7A:
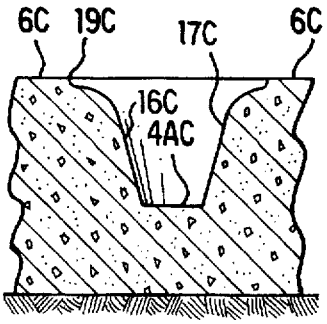
FIG. 7A is a full-size cross-sectional view of a portion of a ground-covering element as molded by the portion of mold of FIG. 7 in which adjacent mold openings have been simultaneously filled, producing stones that are cast monolithically joined.

In FIG. 7A, the cast angular walls 16C and 17C are shown as simulated stone pattern elements 6C cast by replicating the surfaces of walls 16 and 17 of the typical dividing wall of FIG. 6, the cast walls 16C and 17C curving outwards and terminating at cast ledges 19C. The truncated bottom surface 4A produces a cast monolithic connection 4AC between adjacent cast cements 6C.

Figure 7B:
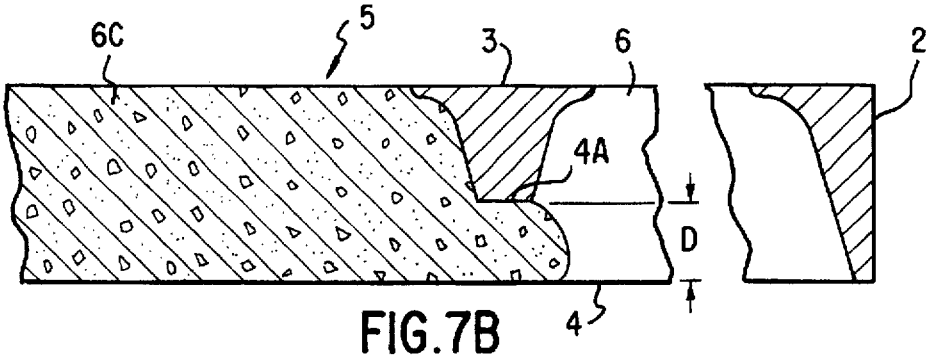
FIG. 7B is a full-size cross-sectional view of a portion of a ground-covering element as molded by the partial dividing wall filling only one side of the portion of the mold of FIG. , producing the edge of a stone pattern selected within the perimeter of the mold.

In FIG. 7B, it is shown that any dividing wall 5 may also separate a cast stone segment 6C from an empty mold segment 6. The intermediate plane 4A of a dividing wall 5 has a distance "D" from bottom surface 4, such that the larger gravel of a typical concrete aggregate will jam up and not flow through the gap. Thus, distance D of between ⅝-inch and ¾-inch forms a concrete dam between an untilled pattern element 6 and a filled, cast element 6C, as shown in FIG. 7B. However, when adjacent mold elements 6 are filled to produce adjacent cast stones 6C, the thickness of distance D is sufficiently strong to provide monolithic integrity in the finished pattern. If distance D was made larger, freshly-poured concrete would flow into the mold clement that is planned to be empty. Conversely, if distance D was made smaller, there may be a gap under the wall, whereby the monolithic structural integrity is lost, or the connection may be too thin to resist breaking in use, and small stones might become loose.

Figure 8:
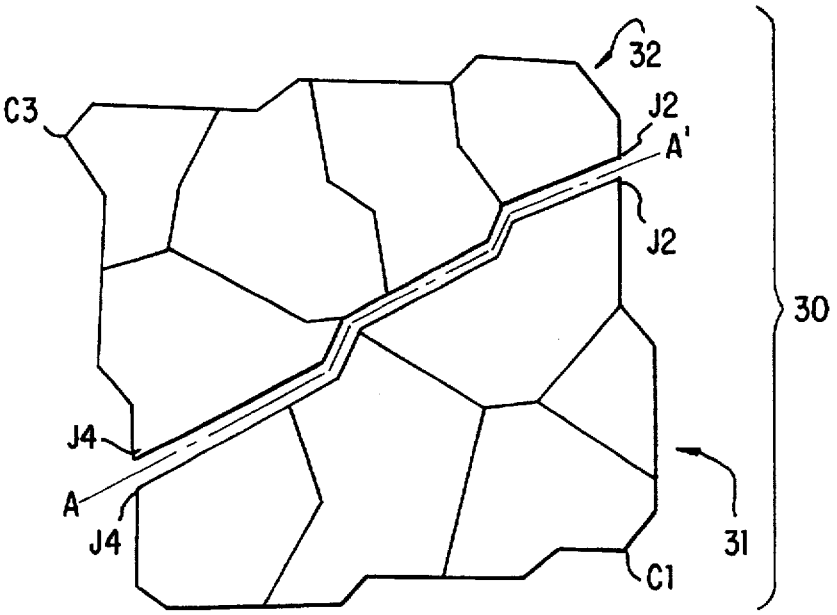
FIG. 8 is a schematic representation showing how either of two triangular portions divided by line A–A' of the mold of FIG. 1 may be filled to produce two different triangular patterns of cast stones.

FIG. 8 shows how two triangular portions J2-C1-J4 and J4-C3-J2 of a generally square molded stone pattern 30 are cast. The triangular portions, divided by line (23A, 23B) in the top planar surface of the mold of FIGS. 1–4, are filled to produce a first triangular pattern of cast stones 31 and a second triangular pattern of cast stones 32.

Figure 9:
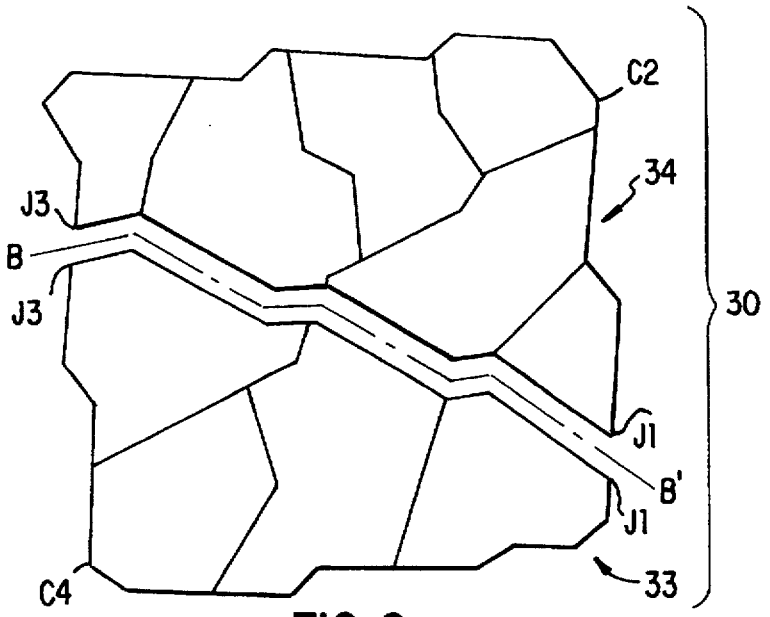
FIG. 9 is a schematic representation of showing how either of two other triangular portions divided by line B–B' of the mold of FIG. 1 may be filled to produce another triangular pattern of cast stones.

FIG. 9 shows how the two other triangular portions J1 C4-J3 and J3-C2-J1, of the same molded pattern 30 as in FIG. 8 are cast. The triangular portions divided by line B—B of the mold of FIGS. 1–4, are filled to produce a third triangular pattern of cast stones 33 and a fourth triangular pattern of cast stones 34.

Figure 11:
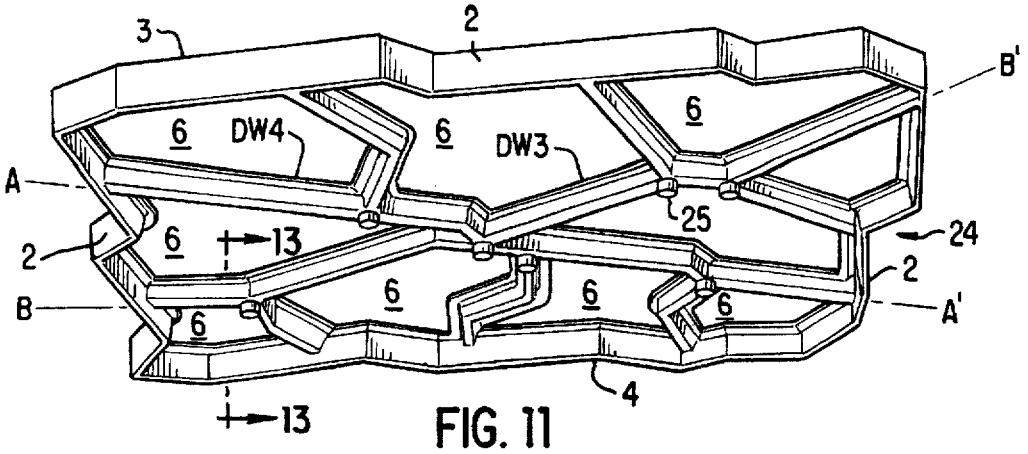
FIG. 11 is a bottom-side perspective view of the mold of FIG. 10.
Figure 10:
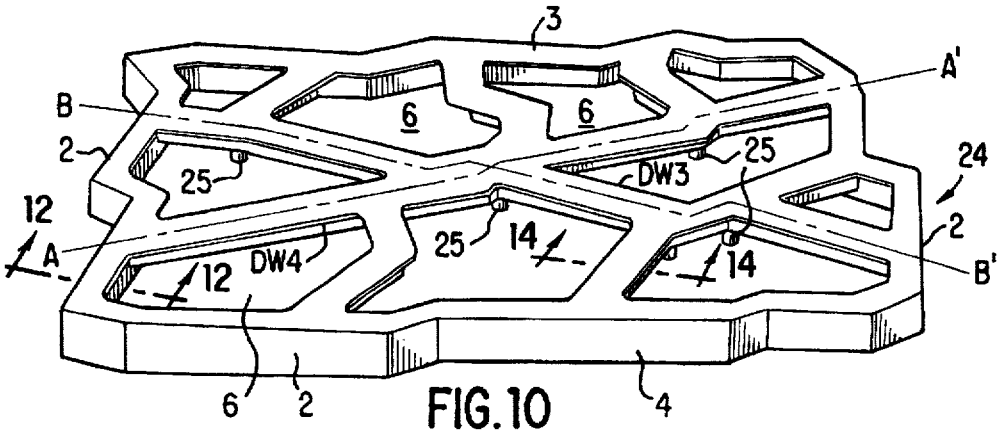
FIG. 10 is a top-side perspective view of a second preferred embodiment of a mold according to the present invention, including partial diagonal walls and partial dividing walls supported on columns.

In FIG. 10, a top perspective view and in FIG. 11, a bottom perspective view, another preferred embodiment mold 24 of the present invention is shown. The entire configuration of the mold may be used to cast a monolithic pattern of stones. In this embodiment, as in mold 1 of FIG. 1–4, the perimeter 2 extends from the top planar surface 3 to the bottom planar surface 4. However, the diagonal walls DW3 and DW4 of the illustrated mold 24, along with the dividing walls 5, extend from the top planar surface 3 only as far as an intermediate plane 4A. Thus, in use, the bottoms of all of the walls excepting the perimeter wall 2 are raised off the ground. In order to provide support for the elevated walls, a plurality of vertical columns 25 are integrally molded as parts of the walls. This permits adequate clearance of the diagonal walls and dividing walls to permit the flow of cement under and between the walls to cast a monolithic pattern of stones.

Figure 12:
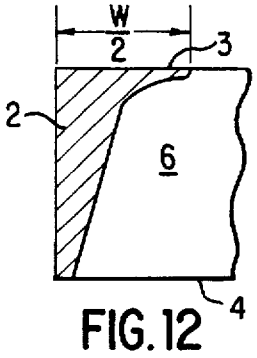
FIG. 12 is a full-size cross-sectional view of a perimeter side wall of the mold of FIG. 10, taken along section line 12—12.

FIG. 12 shows a cross-sectional view, taken along section line 12—12, which is identical to cross-section 6—6 of FIG. 4 and FIG. 6, and in which the perimeter wall 2 casts the simulated stone 6C.

Figure 13:
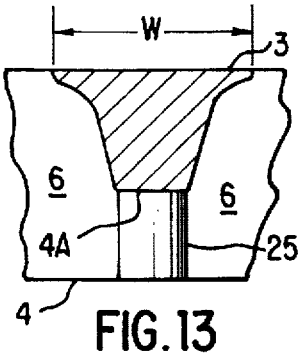
FIG. 13 is an enlarged cross-sectional view of a diagonal wall of the mold of FIG. 11, taken along section line 13—13.
Figure 13A:
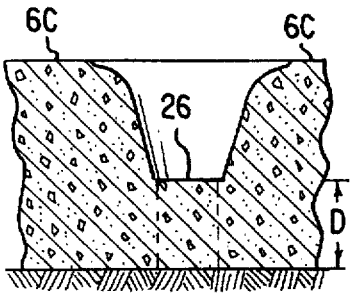
FIG. 13A is a full-size cross-sectional view of a portion of the central section of a ground-covering element as molded by the diagonal wall portion of mold of FIG. 13, in which adjacent stones are being monolithically cast.
Figure 14A:
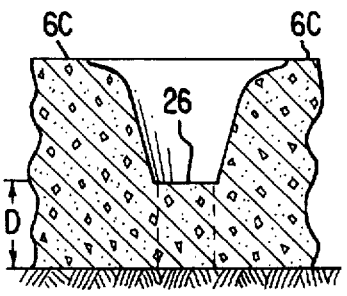
FIG. 14A is a full-size cross-sectional view of a portion of a ground-covering element as molded by a partial dividing wall of FIG. 4, in which adjacent stones are monolithically cast.

FIG. 13 shows a cross-sectional view, taken along section line 13—13, which is different from the cross-section 6—6 of FIG. 4 and FIG. 5. In mold 24 of FIGS. 10 and 11 the diagonal wall DW3 and DW4 extend downward only to the intermediate plane 4A, which is spaced above the bottom plane 4 a distance "D". This spacing permits any adjacent cast stones to be joined together as a single monolithic casting as shown in FIG. 13A.

Figure 14:
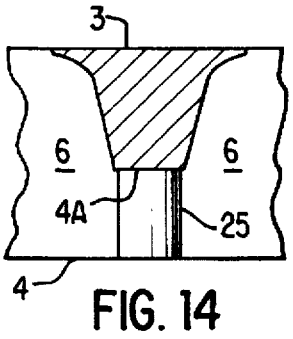
FIG. 14 is a full-size cross-sectional view of a partial dividing wall of the mold of FIG. 10, taken along section line 14—14.
Figure 12A:
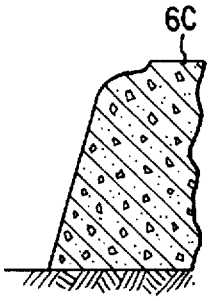
FIG. 12A is a full-size cross-sectional view of a perimeter of a ground-covering element as molded by the portion of mold of FIG. 12.

FIG. 14 shows a cross-sectional view, taken along section line 14—14, which is similar to that shown in the cross-section 7—7 of FIG. 4. This produces the joined stones as shown in FIG. 7A, or the partial cast pattern as shown in FIG. 7B. Thus, due to the optimum distance D, any wall extending between top surface 3 and the intermediate plane 4A, within any perimeter wall configuration extending between top planar surface 3 to bottom planar surface 4, may optionally terminate the stone pattern of the mold. This provides the pattern versatility to produce a wide variety of pattern configurations for a multitude of uses described below.

Figure 15:
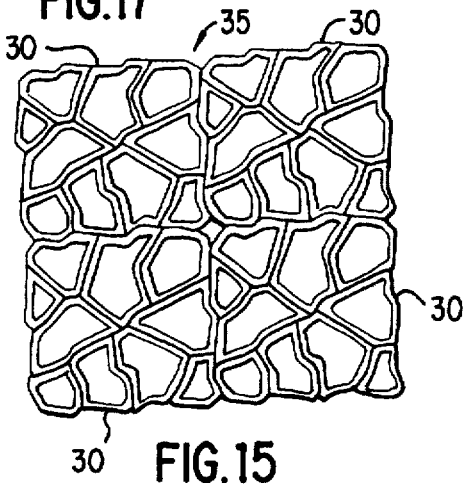
FIG. 15 shows how a plurality of rectangular castings of the mold of FIG. 1 or FIG. 10 may be filled to produce a rectilinear area ground-covering configuration.

FIG. 15 shows a plurality of generally square molded stone patterns 30, as shown in FIG. 8 and FIG. 9, arranged in a rectilinear configuration 35. The dimensions of the patterns are limited only by the desired size of the finished area.

Figure 16:
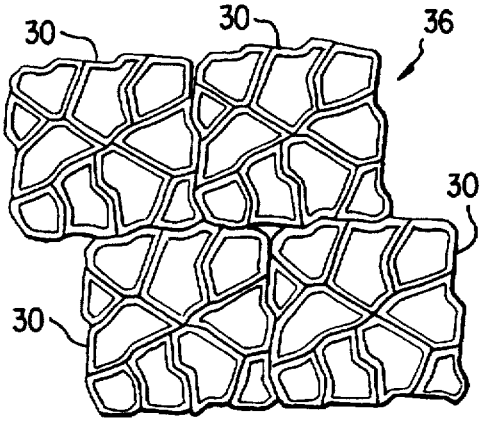
FIG. 16 shows how a plurality of rectangular castings of the mold of FIG. 1 or FIG. 10 may be filled to produce a rectilinear area ground-covering configuration In a staggered orientation.

FIG. 16 shows a plurality of generally square molded stone patterns 30, arranged in a staggered rectilinear configuration 36. Again, the dimensions of the patterns are limited only by the desired size of the finished area.

Figure 17:
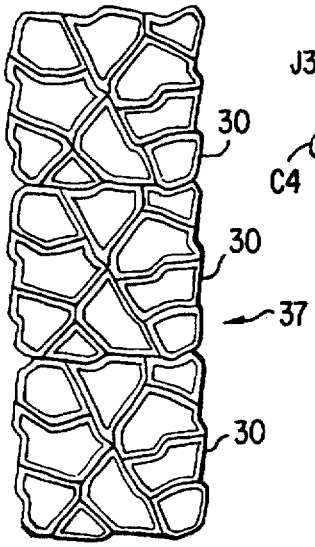
FIG. 17 shows how a plurality of rectangular castings of the mold of FIG. 1 or FIG. 10 may be filled to produce a straight walk ground-covering configuration.

FIG. 17 shows a plurality of generally square molded stone patterns 30, arranged in a straight linear configuration 37.

Figure 18:
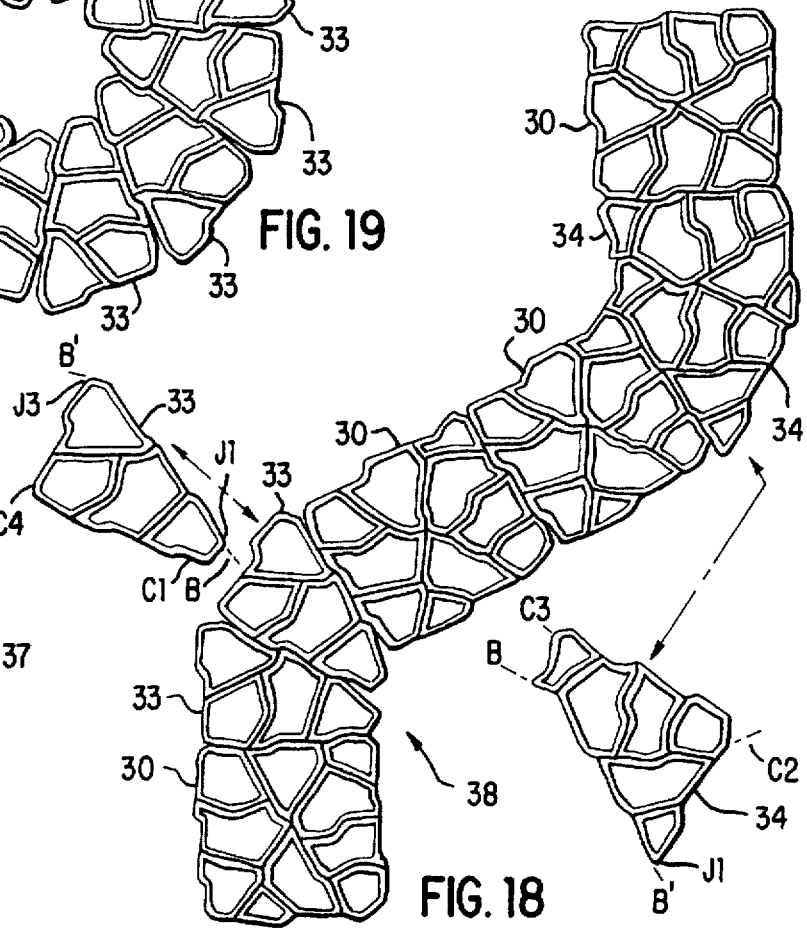
FIG. 18 shows how triangular portions of the mold of FIG. 1 or FIG. 10 may be filled to produce curved walk portions.

FIG. 18 shows a plurality of generally square molded stone patterns 30, arranged in a curved linear configuration 38, in which a right turn curve is produced by the casting of two triangular portions 33. A straight walk section is then produced by a number of square patterns 30 and the left turn curve is produced by casting additional triangular portions 34. The direction of the curve is determined by the triangle selected, and the angle of the turn is determined by the number of successive triangles used.

Figure 19:
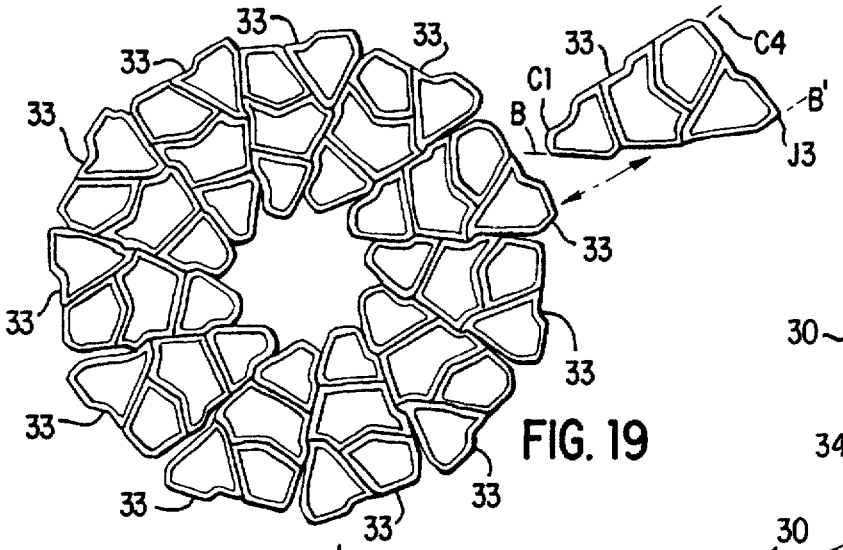
FIG. 19 shows how triangular portions of the mold of FIG. 1 or FIG. 10 may be filled to produce circular walk configurations.

FIG. 19 shows a plurality of generally triangular portions 33, which are successively cast around a complete circle. Other triangular portions may be selected to alter the radius of the circle, permitting circles of different sizes, ellipses, and the like, and with the insertion of square patterns between the triangles, modified circles, such as ovals, may be produced.

Figure 20:
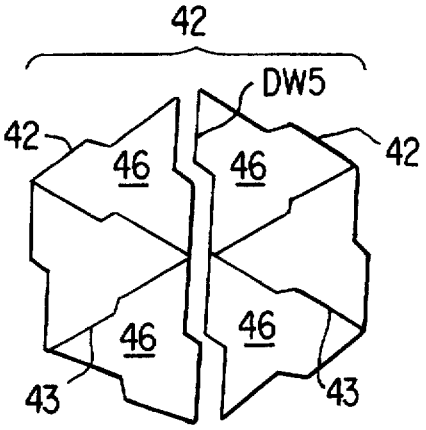
FIG. 20 shows how generally trapezoidal portions of a mold may be filled to produce an irregular polygonal pattern.

FIG. 20 shows a generally-hexagonal polygon pattern 41, which is divided by a diagonal wall DW5 into a pair of identical, generally trapezoidal shapes 42 having complementary sides and diagonals, and having partial dividing walls 43 defining individual stone shapes. The desired size of the mold will determine whether the mold is made in one piece 41 or one or two smaller molds 42.

Figure 21:
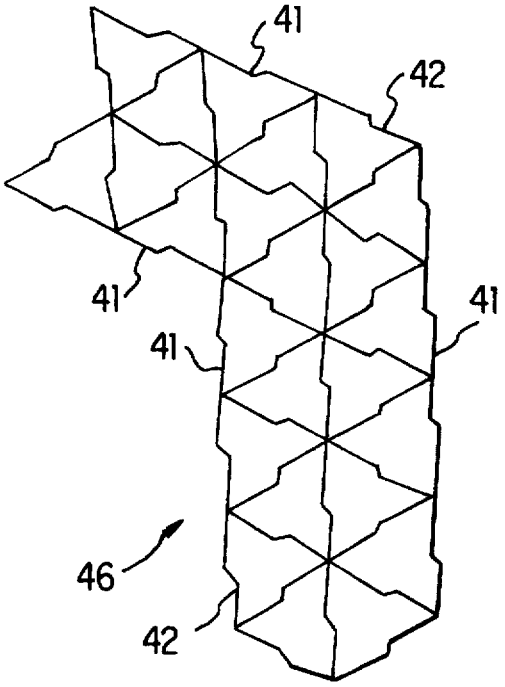
FIG. 21 shows how a plurality of trapezoidal castings of the mold of FIG. 41 may be filled to produce a linear area ground-covering configuration having oblique-direction capability.

FIG. 21 shows a plurality of generally hexagonal molded stone patterns 41 and 42, arranged in a linear configuration 46, in which a left turn curve is produced by the casting of two trapezoidal portions 41. The direction of the curve is determined by the angle on pattern 41 selected.

Figure 22:
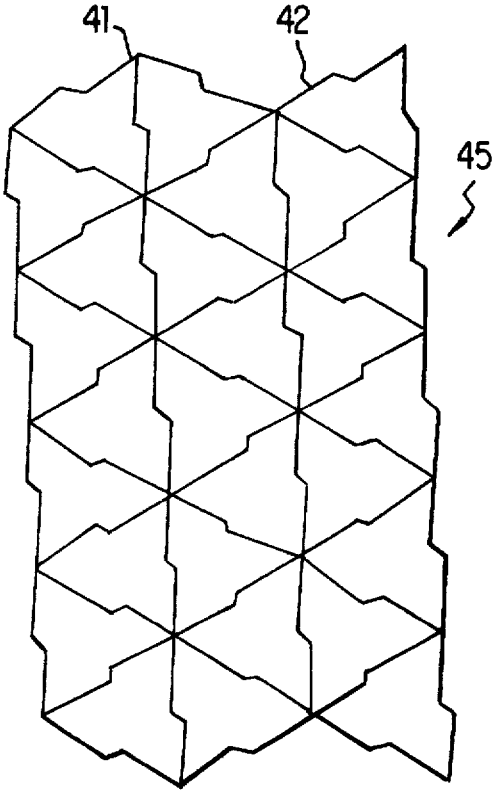
FIG. 22 shows how a plurality of trapezoidal castings of the mold of FIG. 41 may be filled to produce a rectilinear ground-covering configuration.

FIG. 22 shows a plurality of molded stone patterns 41 and/or 42, arranged in a rectilinear configuration 45. The dimensions of the patterns are limited only by the desired size of the finished area.

Figure 23:
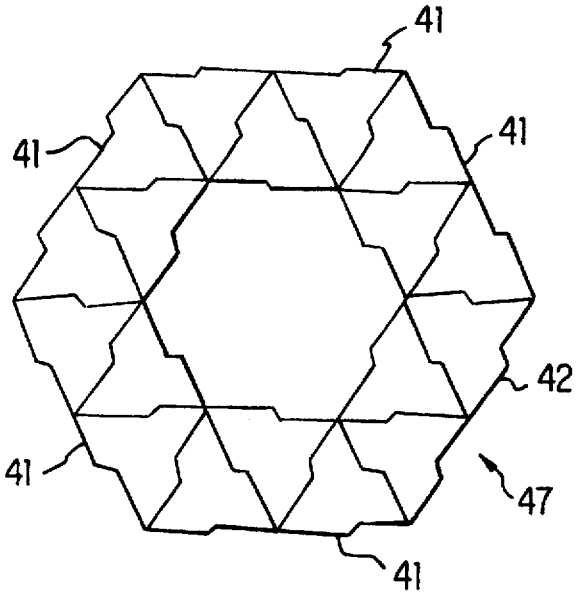
FIG. 23 shows how trapezoidal portions of the mold of FIG. 41 may be filled to produce circular walk configurations.

FIG. 23 shows a trapezoidal mold 42, or half the hexagonal mold 42, which is successively cast to form a complete circle.

Figure 24:
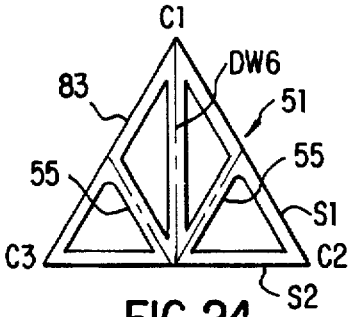
FIG. 24 shows how right-triangle portions of a mold may be filled to produce an isosceles triangle pattern.

FIG. 24 shows a pattern of triangular stones in an isosceles triangular pattern mold 51, which is bisected by a diagonal wall DW6 extending from a first corner C1 to bisect a side S2 between the second corner C2 and the third corner C3, and which has a stone pattern defined by partial dividing walls 55.

Figure 25:
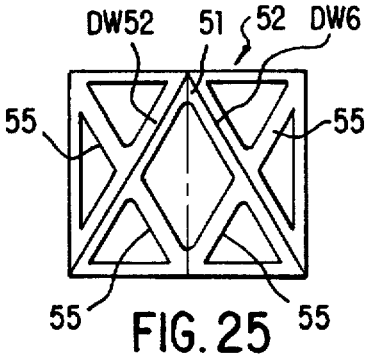
FIG. 25 shows how right-triangle and isosceles triangle portions of a mold may be filled to produce a square pattern.

FIG. 25 shows a pattern of triangular stones, including an isosceles triangular pattern mold 51 having two aides comprising diagonal walls DW6, along with adjacent right-triangle portions to form a square mold 52.

Figure 26:
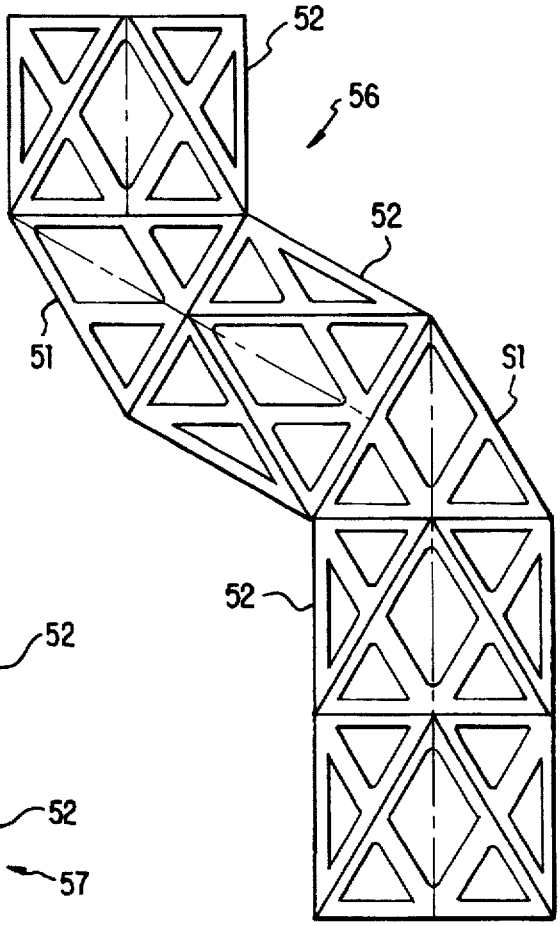
FIG. 26 shows how a plurality of square and triangular castings of the mold of FIG. 24 or FIG. 25 may be filled to produce a linear area ground-covering configuration having oblique-direction capability.

FIG. 26 shows a plurality of square molded stone patterns 52, arranged in a straight and curved linear configuration 56, in which left and right turns are produced by the casting of two triangular portions 51.

Figure 27:
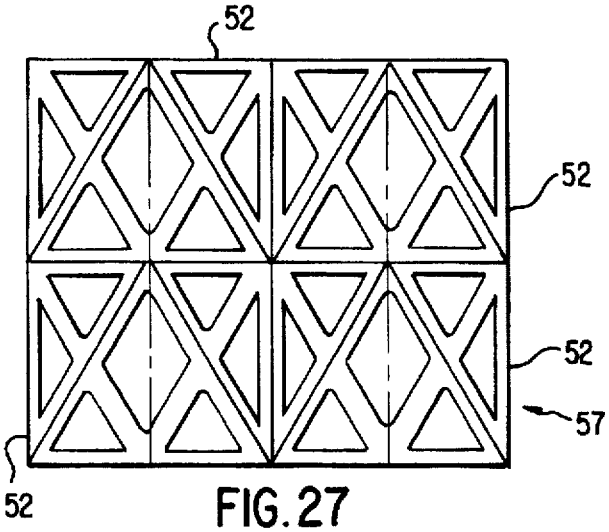
FIG. 27 shows how a plurality of castings of the mold of FIG. 24 or FIG. 25 may be filled to produce a rectilinear ground-covering configuration.

FIG. 27 shows a plurality of square molded stone patterns 52, as shown in FIG. 25, arranged in a rectilinear configuration 57. The dimensions of the patterns are limited only by the desired size of the finished area.

Figure 28:
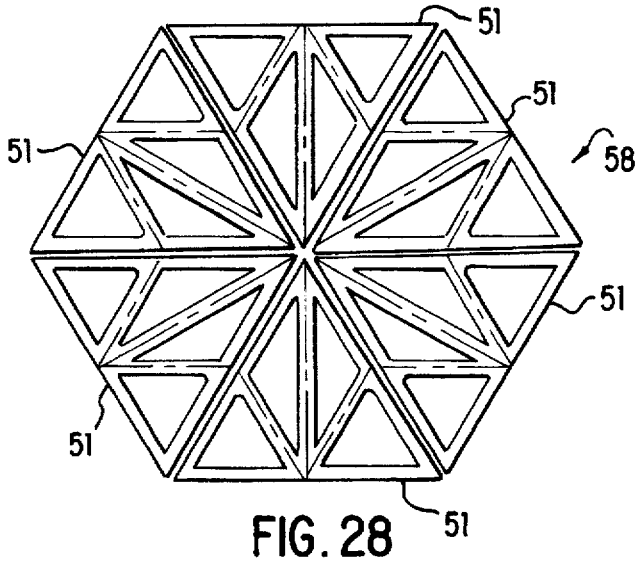
FIG. 28 shows how triangular castings of the mold of FIG. 24 or portions of the mold of FIG. 25 may be filled to produce circular walk configurations.

FIG. 28 shows a plurality of triangular portions 51, which are successively cast around a complete circle. The insertion of square patterns between the triangles, modified circles, such as ovals or rounded squares, may be produced.

FIG. 29 shows a pattern of two trapezoidal patterns 62, having a diagonal wall DW6 and forming portions of a hexagonal mold 61.

FIG. 30 shows a plurality of hexagonal molded stone patterns 61 and trapezoidal patterns 62, arranged in a straight and angular linear configuration 66, in which a left turn (shown) or right turn (not shown) may be produced by the casting of hexagons 62 and a triangular portion 63.

FIG. 31 shows a plurality of hexagonal 61 and trapezoidal sections 62, arranged in a rectilinear configuration 67. The dimensions of the patterns are limited only by the desired size of the finished area.

FIG. 32 shows a plurality of hexagonal portions 61, which are successively cast around a complete circle. The insertion of trapezoidal patterns 62 between the hexagons, modified circles, such as ovals or rounded squares, may be produced.

Although the invention has been described in terms of special embodiments which are set forth in detail, it should be understood that this is by illustration only and that the invention is not necessarily limited thereto since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A polygonal mold for ground-covering stones comprising:

a mold (1) having a generally square perimeter (2), having a planar top surface (3), a bottom surface (4) in a parallel plane, said perimeter (2) having first and second corners (C1, C2) connected by a first perimeter wall (S1), second and third corners C2, C3) connected by a second perimeter wall (S2), third and fourth corners (C3, C4) connected by a third perimeter wall (S3) and fourth and first (C4, C1) corners connected by a fourth perimeter wall (S4), each said perimeter wall having a plan shape comprising a series of contiguous, successive straight line segments (20) connected at obtuse angles forming alternating projections (21) and recesses (22);

a first diagonal separating wall (DW1) extending proximate the second corner (C2) to proximate the fourth corner (C4) and comprising a common wall extending between the planar top surface (3) and the parallel plane of the bottom surface (4) of the perimeter walls, said diagonal separating wall separating the generally square perimeter into first and second generally triangular portions (J2-C3-J4 and J4-C1-J2);

a second diagonal separating wall (DW2) extending proximate the first corner (C1) to proximate the third corner (C3) and comprising a common wall extending between the planar top surface (3) and the parallel plane of the bottom surface (4) of the perimeter walls, said diagonal wall separating the generally square perimeter into third and fourth generally triangular portions (J1-C2-J3 and J3-C4-J1); and a plurality of partially dividing walls (5) extending from the top planar surface (3) to an intermediate plane (4A) above the plane of the bottom surface (4), said dividing walls dividing each of the generally triangular portions into a plurality of openings (6) wherein:

the first perimeter wall (S1) is geometrically complementary to the third perimeter wall (S3);

the second perimeter wall (S2) is geometrically complementary to the fourth perimeter wall (S4);

the first diagonal wall (DW1) is geometrically complementary to the second and fourth perimeter walls (S2, S4); and the second diagonal wall (DW2) is also geometrically complementary to the second and fourth perimeter walls (S2, S4).

2. A mold for ground-covering stones according to claim 1 in which the generally triangular portions (J1-C2-J3, J3-C4-J1, J2-C3-J4 and J4-C1-J2) comprise approximately 30°, 60°, 90° triangles in which one side and the hypotenuse of each triangle are geometrically complementary to each other and geometrically complementary to at least one perimeter wall.

3. A mold for ground-covering stones according to claim 1 in which each of the generally triangular portions is divided by dividing walls (5) into a plurality of irregularly shaped openings (6).

4. A mold for casting ground-covering stones according to claim 1 in which the diagonal walls (DW1) have a cross-sectional shape of a "T" having a "V"-shaped vertical member (14, 15) extending from the plane of the bottom surface (4) to a planar-top cross-member having a width W in the plane (3) of the top surface of the mold (1), said vertical members (14, 15) having undersides tapering to opposed top surface edges (19) defining width W; and the dividing walls (5) also have a cross-sectional shape of a "T" including a V-shaped vertical member (16, 17) extending from the plane (4A) intermediate of the bottom surface (4) to a planar-top cross-member in the plane (3) of the top surface of the mold (1), said dividing wall vertical members (14B, 14C) having undersides tapering to opposed top surface edges (19).

5. A mold for casting ground-covering stones according to claim 4 in which the perimeter walls (2) have a cross-sectional shape of an inverted "L" having a planar-top member in plane (3) of the top surface and having a width of W/2.

6. A mold for casting ground-covering stones according to claim 4 in which the top planar surface (3) of the "T" shape of each diagonal wall (DW1, DW2) is provided with a line (23A, 23B) extending along at least one of the diagonal separating walls.

7. A polygonal mold for ground-covering stones, said polygonal mold having alternating projections and recesses nestable with companion recesses and projections on another mold, comprising:

a mold (1) having a perimeter (2) in the general shape of a polygon selected from the group including rectangle and hexagon, said perimeter having a planar top surface (3), a bottom surface in a parallel plane (4), said perimeter (2) having corners (C) connected by perimeter walls (S), each said perimeter wall having a plan shape comprising a series of contiguous, successive line segments (20) connected at obtuse angles forming said alternating projections (21) and recesses (22) nestable with the companion recesses and projections on said another mold;

at least one diagonal separating wall (DWI) extending proximate a first corner (C2) of the polygon to proximate another corner (C4) and comprising a common wall extending between the planar top surface (3) and the plane of the bottom surface (4) of the perimeter walls, said separating wall isolating the perimeter into first and second generally polygonal portions (J2-C3-J4 and J4-C1-J2);

a plurality of partial dividing walls (5) extending from the top planar surface (3) to an intermediate plane (4A) above the bottom planar surface (4), said dividing walls dividing each of the generally triangular forms into a plurality of openings (6) connected between the bottom planar surface (4) and the intermediate plan (4A) wherein;

said perimeter walls (S1) are geometrically complementary to the diagonal separating wall (DWI).

8. A mold for ground-covering stones, said mold having projections and recesses nestable with companion recesses and projections on another mold, comprising:

a mold (1) having a perimeter (2) in the general shape of a polygon selected from the group including rectangle and hexagon, said perimeter having a planar top surface (3), a parallel planar bottom surface (4), said perimeter (2) having corners (C) connected by perimeter walls (S), each said perimeter wall having a plan shape comprising a series of contiguous, successive line segments (20) connected at angles forming said projections and recesses nestable with the companion recesses and projections on said another mold;

at least one partial diagonal separating wall (DWI) extending proximate a first corner (C2) of the polygon to proximate another corner (C4) and comprising a common wall extending between the planar top surface (3) and a parallel planar intermediate surface (4A) of the perimeter walls, said diagonal wall separating the perimeter into first and second generally polygonal portions (J2-C3-J 4 L and (J4-C1-J2):

a plurality of partial dividing walls (5) extending from a partial diagonal wall to a perimeter wall, said partial dividing walls extending from the top planar surface (3) to the intermediate plane (4A) above the bottom planar surface (4), said partial dividing walls dividing each of the generally polygonal portions into a plurality of openings (6) connected between the bottom planar surface (4) and the intermediate plane (4A); and wherein said perimeter walls (S1) are geometrically complementary to the diagonal separating wall (D).

9. A mold for ground-covering stones according to claim 1,7 or 8 in which the intermediate plane (4A) is approximately equidistant between top planar surface (3) and bottom planar surface (4).

10. A mold for ground-covering stones according to claim 1, 7 or 8 in which the intermediate plane (4A) is a distance of between ⅝-inch and ¾-inch above the bottom planar surface (4).

11. A mold for ground-covering stones according to claim 9 in which a plurality of vertical columns extend from the partial dividing walls to the plane of the bottom surface (4) of the perimeter walls.

12. A mold for ground-covering stones according to claim 8 in which the plurality of openings are regular polygonal shapes.

13. A mold for ground-covering stones according to claim 8 in which the plurality of openings are irregular polygonal shapes.

14. A mold for ground-covering stones according to claim or 8 in which the plurality of openings irregular shapes.

15. A mold for ground-covering stones comprising:

a mold (1) having a perimeter (2) in the general shape of a triangle, said perimeter having a planar top surface (3), a parallel planar bottom surface (4), said perimeter (2) having corners (C1-C3) connected by perimeter walls (S1-S3), each said perimeter wall having a plan shape comprising a series of contiguous, successive straight line segments (20) connected at angles;

at least one partial diagonal wall (DW6) extending from a first corner (C1) of the triangle to bisect an opposite perimeter wall and comprising a common wall extending between the planar top surface (3) and the parallel planar bottom surface (4A) of the perimeter walls, said diagonal wall separating the perimeter into first and second right-triangles;

a plurality of partial dividing walls (55) extending from the diagonal wall to the perimeter walls, said partial dividing walls extending from the top planar surface (3) to an intermediate plane (4A) above the bottom planar surface (4), said partial dividing walls also dividing each of the right triangles into a plurality of openings (6) connected between the bottom planar surface (4) and the intermediate plane (4A).

16. A mold for ground-covering stones according to claim 1 or 7 in which the plurality of openings are regular polygonal shapes.

17. A mold for ground-covering stones according to claim 1 or 7 in which the plurality of openings are irregular polygonal shapes.

18. A mold for ground-covering stones according to claim 1 or 7 in which the plurality of openings are irregular shapes.

* * * * *